US007672617B2

(12) United States Patent
Sugimoto et al.

(10) Patent No.: US 7,672,617 B2
(45) Date of Patent: Mar. 2, 2010

(54) IMAGE APPARATUS WITH TONER REPLENISHING

(75) Inventors: Hiroko Sugimoto, Osaka (JP); Hirohisa Endou, Osaka (JP); Yukihiro Mori, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 412 days.

(21) Appl. No.: 11/600,159

(22) Filed: Nov. 16, 2006

(65) Prior Publication Data

US 2007/0122199 A1 May 31, 2007

(30) Foreign Application Priority Data

Nov. 30, 2005 (JP) ..... 2005-346753

(51) Int. Cl.
*G03G 15/01* (2006.01)

(52) U.S. Cl. ..... 399/227; 399/224

(58) Field of Classification Search ..... 399/227, 399/258, 224
See application file for complete search history.

(56) References Cited

U.S. PATENT DOCUMENTS

| | | | | |
|---|---|---|---|---|
| 7,257,355 | B2 * | 8/2007 | Tomoe et al. | 399/258 |
| 7,274,899 | B2 * | 9/2007 | Tomoe | 399/227 |
| 7,437,103 | B2 * | 10/2008 | Maeshima et al. | 399/227 |
| 2006/0093401 | A1 * | 5/2006 | Tanda | 399/227 |
| 2006/0093402 | A1 * | 5/2006 | Tomoe | 399/227 |
| 2006/0093403 | A1 * | 5/2006 | Tanda | 399/227 |
| 2006/0193659 | A1 * | 8/2006 | Tanda | 399/258 |
| 2007/0048026 | A1 * | 3/2007 | Tanabe | 399/258 |
| 2007/0201903 | A1 * | 8/2007 | Tsuchihashi et al. | 399/258 |
| 2007/0253745 | A1 * | 11/2007 | Maruyama | 399/258 |

FOREIGN PATENT DOCUMENTS

| | | | |
|---|---|---|---|
| JP | 61097674 | A * | 5/1986 |
| JP | 06-102765 | | 4/1994 |
| JP | 09-185238 | | 7/1997 |
| JP | 10-198149 | | 7/1998 |
| JP | 2001-134045 | | 5/2001 |
| JP | 2003-295571 | | 10/2003 |
| JP | 2003-307934 | | 10/2003 |
| JP | 2004-29056 | | 1/2004 |
| JP | 2004-233559 | | 8/2004 |

* cited by examiner

*Primary Examiner*—Susan S Lee
(74) *Attorney, Agent, or Firm*—Shinjyu Global IP

(57) ABSTRACT

An imaging apparatus has an image carrier, an exposure unit to irradiate the image carrier; a developing part; a rotator on which a plurality of such developing parts is provided; a color toner replenishing part which moves from a retracted position where light emitted from the exposure unit is not obstructed, to a replenishing position where light emitted from the exposure unit is obstructed, and with which the color toner of the color developing part in the replenishing position is replenished; and a black toner replenishing part which is disposed in a position where light emitted from the exposure unit is not obstructed and with which the black toner is replenished to the black developing part in the replenishing position.

6 Claims, 5 Drawing Sheets

IMAGE APPARATUS WITH TONER REPLENISHING

CROSS-REFERENCE TO RELATED APPLICATIONS

This application claims priority to Japanese Patent Application No. 2005-346753 filed on Nov. 30, 2005. The entire disclosure of Japanese Patent Application No. 2005-346753 is hereby incorporated herein by reference.

BACKGROUND OF THE INVENTION

1. Field of the Invention

The present invention generally relates to an imaging apparatus. More specifically, the present invention relates to an imaging apparatus that replenishes the toner of a developing unit.

2. Background Information

There are imaging apparatuses that are provided with a rotary developing unit in which a plurality of developing parts is disposed on the external periphery and in which the developing part for the toner color being developed is rotated to a developing position that faces an image carrier for each of the colors being developed, whereby the color is developed while the toner color is changed.

An imaging apparatus disclosed in JP (Kokai) 10-198149 includes such a rotary developing unit. The imaging apparatus is configured so that when the developing parts are in a developing position facing a photosensitive drum, the developing parts will be replenished with toner via a first toner replenishing pipe, and when the developing parts are in a position other than the developing position, the developing parts will be replenished with toner via a second toner replenishing pipe.

An imaging apparatus disclosed in JP (Kokai) 2001-134045 includes such a rotary developing unit in which a plurality of developing parts is disposed across the maximum width in the main scanning direction of an electrostatic latent image and which develop the electrostatic latent image on a photosensitive drum, wherein the developing part for a toner of the color being developed is rotated to a developing position that faces the photosensitive drum for each of the colors being developed. A cylindrical toner replenishing part having a plurality of toner replenishing openings to replenish the toner of the developing parts is disposed in a position where light emitted from an exposure unit is not obstructed by an end portion of the rotary developing unit. The opening to replenish the toner whose color corresponds to the developing part in the developing position is brought to an upper surface position, whereby the toner whose color corresponds to the developing part in the developing position is replenished from the toner replenishing part. Therefore, the toner can be replenished without the imaging process being interrupted.

An imaging apparatus disclosed in JP (Kokai) 9-185238 similarly includes a rotary developing unit. However, a cylindrical toner replenishing mechanism that stocks four colors of toner is provided to an end portion of the developing unit. The toner replenishing mechanism is similarly disposed in a position where light emitted from the exposure unit is not obstructed, and the toner can therefore be replenished without the imaging process being interrupted.

However, when the toner is replenished in the imaging apparatus disclosed in JP (Kokai) 10-198149, the toner replenishing pipe must be moved from a retracted position, where light emitted from the exposure unit is not obstructed, to a replenishing position that is separated from the retracted position, where light emitted from the exposure unit is obstructed; and the exposure is obstructed while the toner is being replenished. Therefore, a problem is presented in that the imaging process is interrupted each time the toner is replenished. In particular, monochromatic printing having high toner consumption is continuously performed, the number of times that the toner is replenished increases and the number of interruptions in the imaging process increases, which can create irritation on the part of the user.

In the imaging apparatus disclosed in JP (Kokai) 2001-134045, the toner replenishing parts are disposed in a position where light emitted from the exposure unit is not obstructed. The toner can therefore be replenished without the imaging process being interrupted. However, to adopt such a configuration, a long space must be provided in the direction of the rotational axis of the developing unit because the plurality of toner replenishing parts is disposed in a position where light emitted from the exposure unit is not obstructed, and a problem arises in that the size of the apparatus is increased.

In the imaging apparatus disclosed in JP (Kokai) 9-185238 as well, a large cylindrical space must be provided in order to install a toner cartridge in a position where light emitted from the exposure unit is not obstructed by the end portion of the developing unit, and a problem arises in that the size of the apparatus increases.

In view of the above, it will be apparent to those skilled in the art from this disclosure that there exists a need for an improved imaging apparatus. This invention addresses this need in the art as well as other needs, which will become apparent to those skilled in the art from this disclosure.

SUMMARY OF THE INVENTION

The present invention was developed in view of the forgoing circumstances, and it is an object thereof to provide an imaging apparatus wherein the incidence of exposure being impeded when the toner is replenished is minimized while the apparatus is prevented from being made larger.

To achieve the abovementioned object, the imaging apparatus of the present invention is equipped with an image carrier to carry an electrostatic latent image; an exposure unit to irradiate the image carrier with light and to form the electrostatic latent image; a color developing part to develop the electrostatic latent image on the image carrier by using a color toner; a black developing part to develop the electrostatic latent image on the image carrier by using a black toner; a rotator in which the color developing part and black developing part are disposed on the external periphery thereof and in which the color developing part or black developing part is moved by rotation to a developing position that faces the image carrier in accordance with the color being developed; a color toner replenishing part that moves from a retracted position where light emitted from the exposing is not obstructed, to a replenishing position where light emitted from the exposure unit is obstructed, and with which the color toner of the color developing part is replenished in the replenishing position; and a black toner replenishing part which is disposed in a position where light emitted from the exposure unit is not obstructed and with which the black toner is replenished to the black developing part in the replenishing position.

In the invention, the black toner replenishing part to replenish black toner, which is used often in monochromatic printing as has been described hereinabove, replenishes black toner in the black developing part in a position where light emitted from the exposure unit is not obstructed. The color toner replenishing part that replenishes non-black color toner, which is not used often in monochromatic printing, is moved from a retracted position where light emitted from the exposure unit is not obstructed to a replenishing position where light emitted from the exposure unit is obstructed, and replenishes the color toner of the color developing part. In this way, only the black toner replenishing part is disposed in a position outside the exposure area. Therefore, the apparatus can be very effectively kept from increasing in size as compared with conventional imaging apparatuses, in which both the color toner replenishing part and the black toner replenishing part are disposed in positions outside the exposure area. It shall be apparent that user irritation can be lessened because the imaging process will not be interrupted by the replenishing of toner when a black monochromatic imaging process is being continuously performed.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

An embodiment of the present invention shall hereunder be described with reference to the attached drawings to aid in understanding the present invention. The following embodiment is an example used to provide a specific illustration of the present invention and is not meant to limit the technological range of the present invention.

Figure 1:
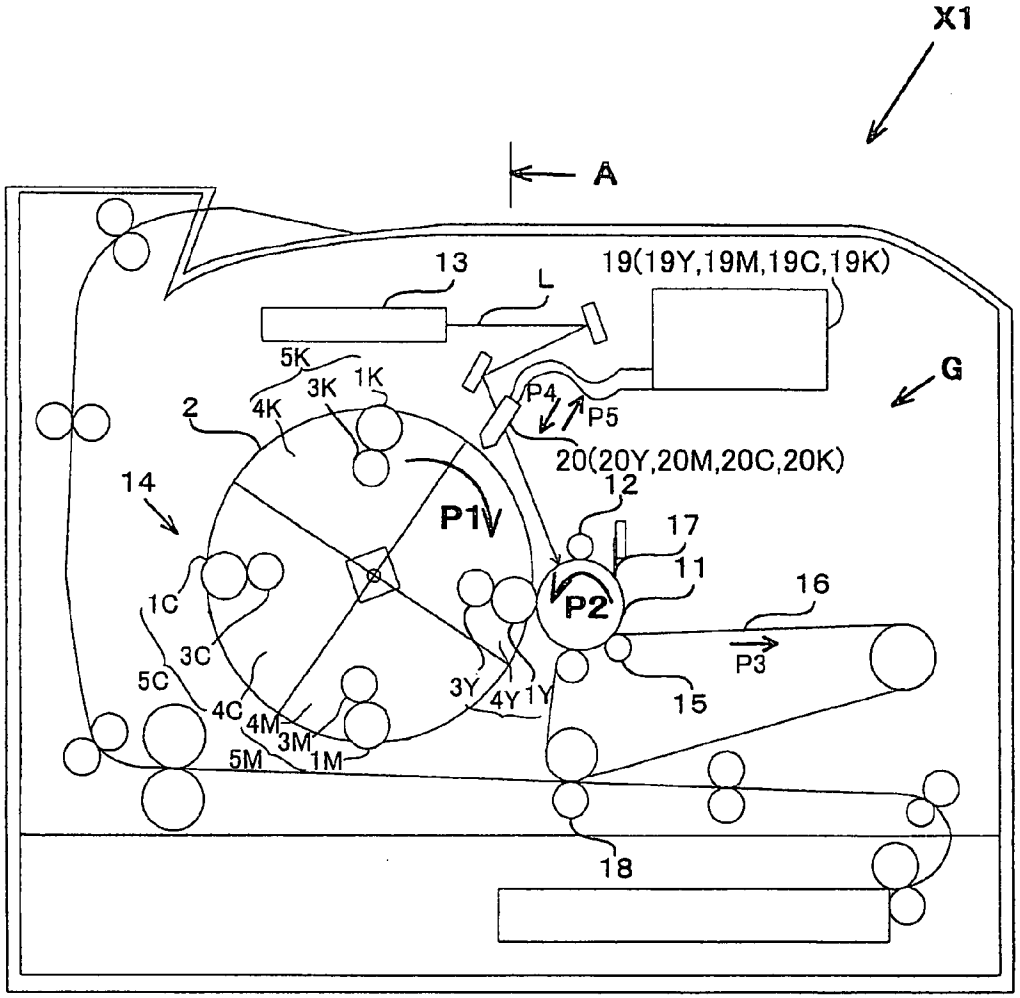
FIG. 1 is a schematic cross-sectional view as seen from a side surface of an imaging apparatus according to a preferred embodiment of the present invention.
Figure 2:
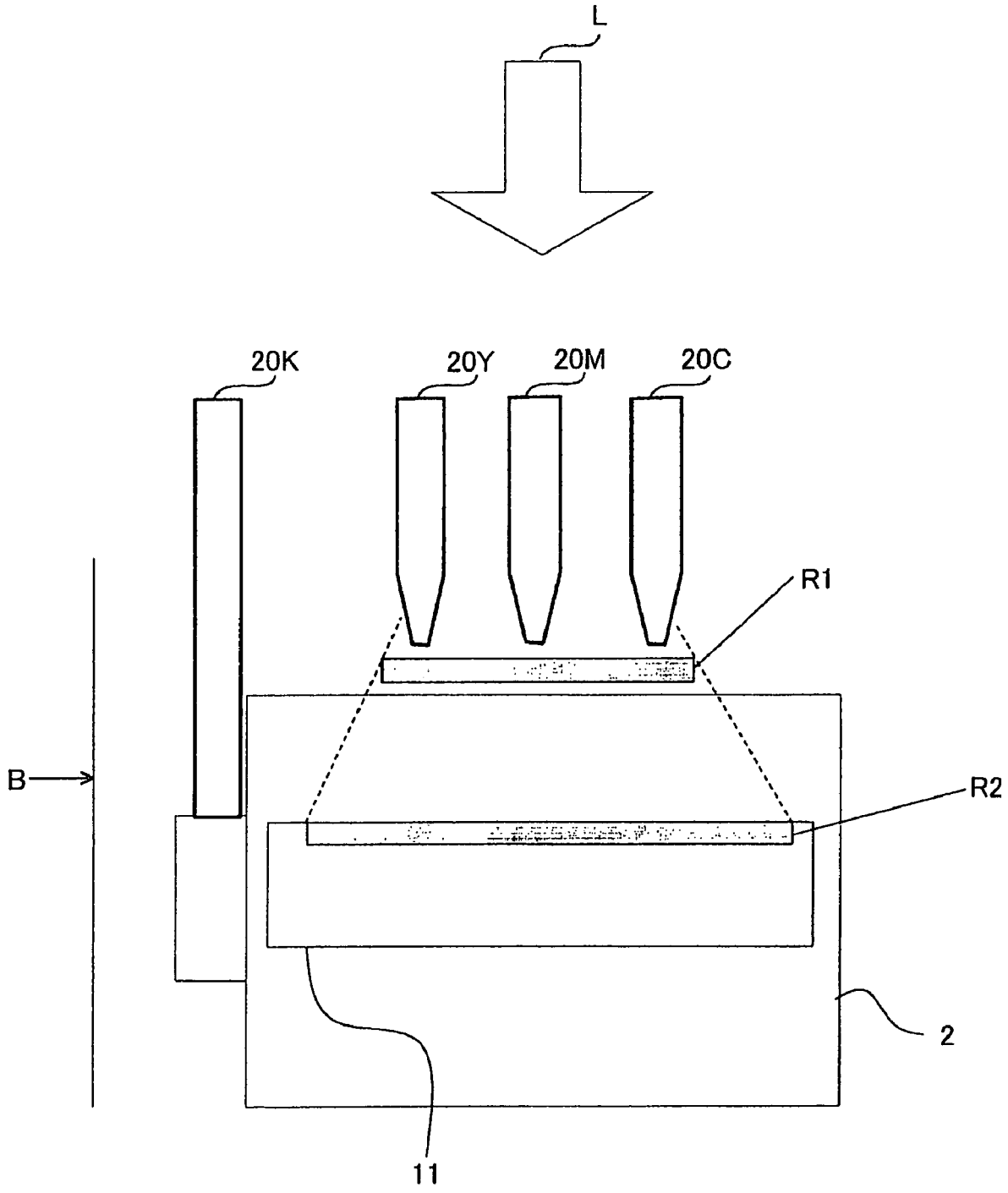
FIG. 2 is an enlarged elevational view of the periphery of a toner replenishing part of the imaging apparatus according to the preferred embodiment of the present invention as seen from the direction of the arrow A shown in FIG. 1.
Figure 3A:
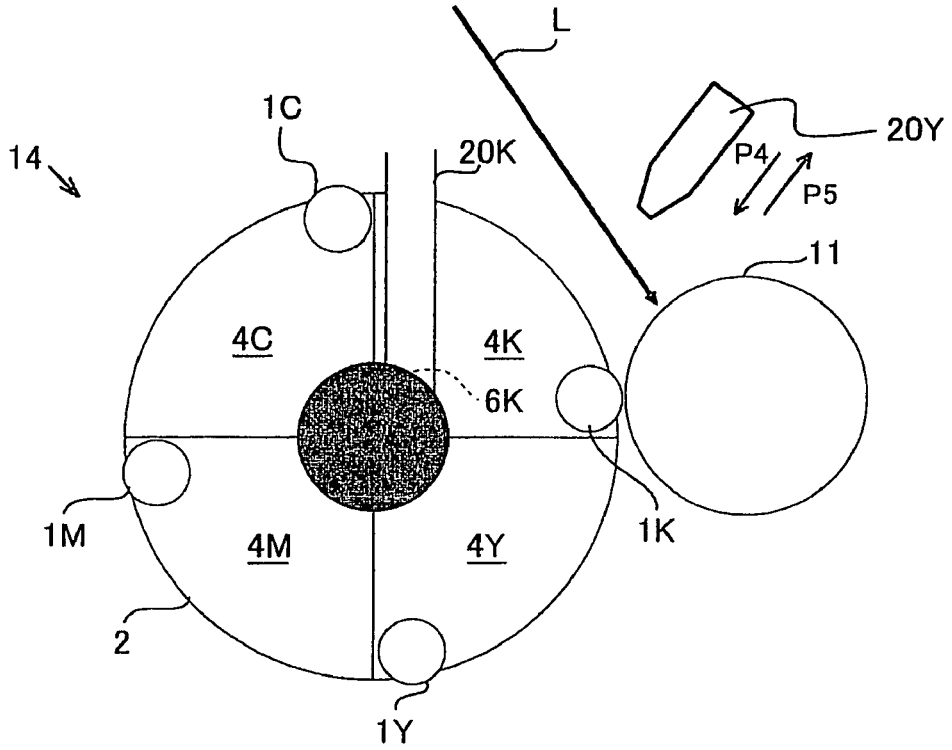
FIG. 3A is a schematic view of a developing unit and toner replenishing part of the imaging apparatus according to the preferred embodiment of the present invention as seen from the direction of the arrow B shown in FIG. 2 when a black developing roller is in a developing position.
Figure 3B:
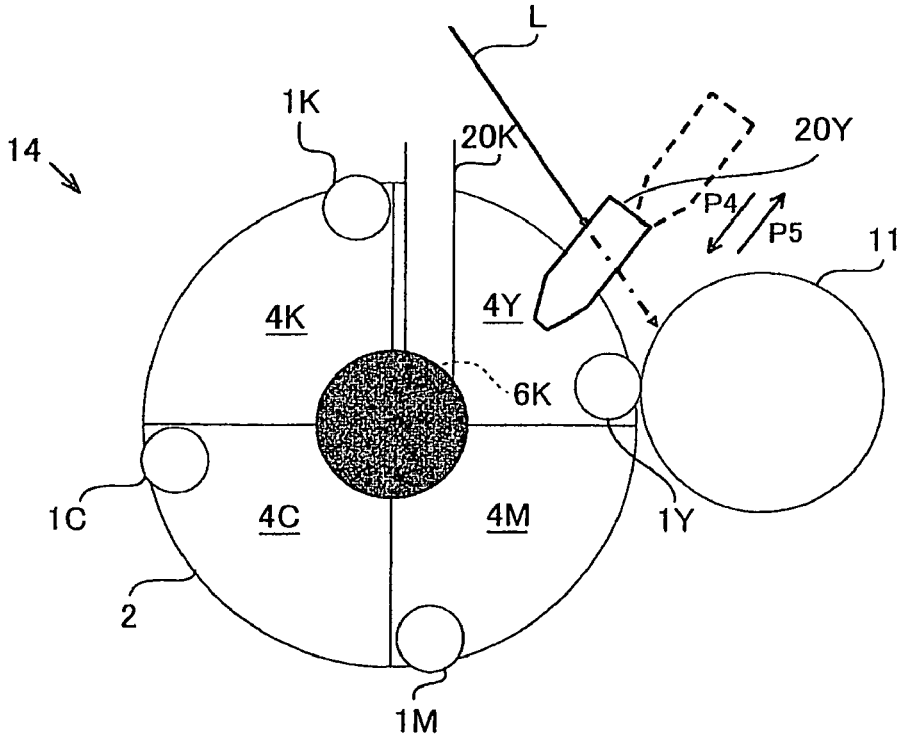
FIG. 3B is a schematic view of the developing unit and toner replenishing part of the imaging apparatus according to the preferred embodiment of the present invention as seen from the direction of the arrow B shown in FIG. 2 when the black developing roller is in a position other than the developing position.
Figure 4:
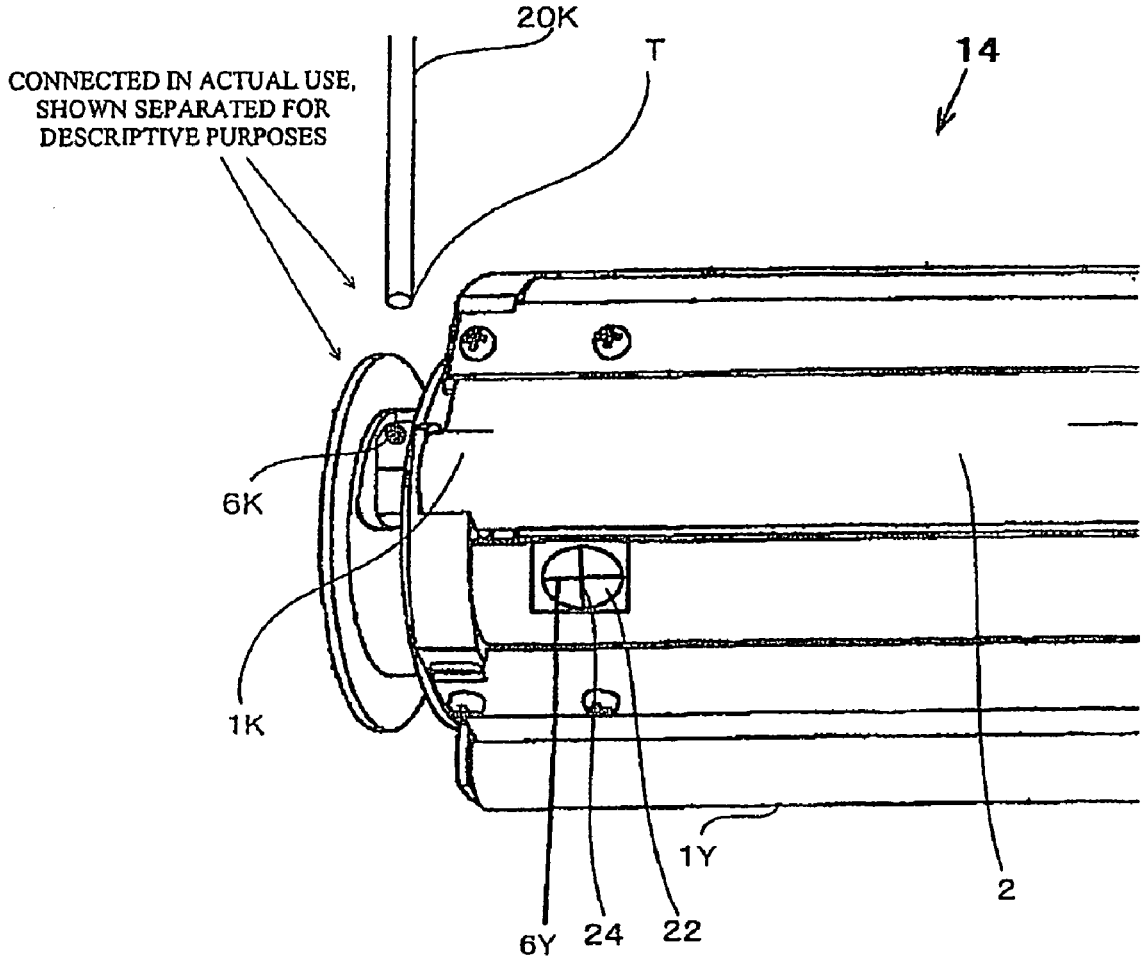
FIG. 4 is an enlarged perspective view of the area around a toner replenishing opening in the developing unit of the imaging apparatus according to the preferred embodiment of the present invention.
Figure 5:
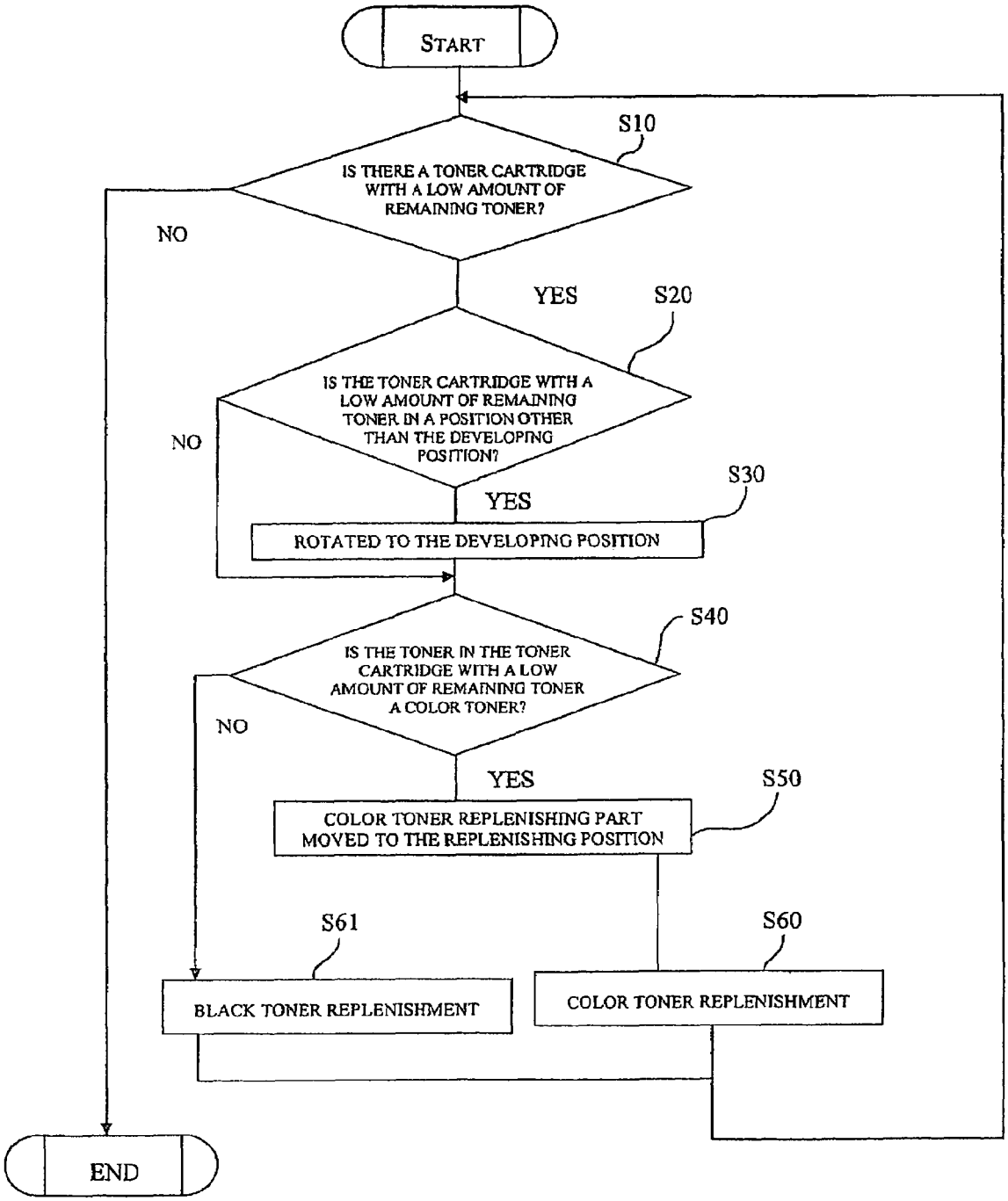
FIG. 5 is a view of a flow chart provided to describe an example of the sequence of a toner replenishing process executed by a controller of the imaging apparatus according to the preferred embodiment of the present invention.

FIG. 1 is a schematic cross-sectional view as seen from the side surface of an imaging apparatus X1 according to a preferred embodiment of the present invention. FIG. 2 is an enlarged elevational view of a periphery of a toner replenishing part 20 of the imaging apparatus according to the preferred embodiment of the present invention as seen from the direction of the arrow A shown in FIG. 1. FIG. 3A is a schematic view of a developing unit 14 and toner replenishing part 20K of the imaging apparatus X1 according to the preferred embodiment of the present invention as seen from the direction of the arrow B shown in FIG. 2 when a black developing roller 1K is in a developing position. FIG. 3B is a schematic view of the developing unit 14 and toner replenishing part 20 of the imaging apparatus X1 according to the preferred embodiment of the present invention as seen from the direction of the arrow B shown in FIG. 2 when the black developing roller 1K is in a position other than the developing position. FIG. 4 is an enlarged view of an area around a toner replenishing opening 6 in the developing unit 14 of the imaging apparatus X1 according to the preferred embodiment of the present invention. FIG. 5 is a view of a flow chart provided to describe an example of the sequence of a toner replenishing process executed by a controller of the imaging apparatus X1 according to the preferred embodiment of the present invention.

In FIG. 4, the connection between the developing unit 14 and the toner replenishing part 20K, which are normally connected and fixed together, is depicted as being disconnected in order to simplify the description of the area around the connection.

The imaging apparatus X1 according to the embodiment of the present invention is a color imaging apparatus having the four colors of yellow (Y), magenta (M), cyan (C), and black (K). Further, the imaging apparatus Xi is a rotary four-color imaging apparatus in which developing rollers of each color are disposed on the external periphery of the apparatus and in which images are developed using developing parts that cause the developing roller of the toner of the color being developed to rotate to a developing position facing a photosensitive drum (an example of an image carrier).

First, an overview configuration of an imager G provided to the imaging apparatus X1 according to the embodiment of the present invention shall be described using the schematic cross-sectional view of FIG. 1.

The imager G has a photosensitive drum or image carrier 11 to support an electrostatic latent image; a charger 12 to cause the surface of the photosensitive drum 11 to be uniformly charged; an exposure unit or part 13 to emit a laser beam onto the photosensitive drum 11 and to form an electrostatic latent image; a developing unit 14 to cause toner contained in a developing agent to adhere to the latent image and to form a toner image on the surface of the photosensitive drum 11; an intermediate transfer belt 16 whereby the toner image developed on the photosensitive drum 11 is transferred; a primary transfer roller 15 that is pressed against the photosensitive drum 11 with the intermediate transfer belt 16 interposed therebetween; a cleaning part 17 to clean the photosensitive drum 11 after the primary transfer; a neutralizing lamp (not shown) to remove the electrical potential remaining on the photosensitive drum after the primary transfer; toner containers 19Y, 19M, 19C, and 19K in which replenishing toner is stored; toner replenishing parts 20Y, 20M, 20C, and 20K to replenish respectively the developing unit 14 with the toner contained in the toner containers 19Y, 19M, 19C, and 19K; a secondary transfer roller 18 whereby the toner image transferred in the primary transfer onto the intermediate transfer belt 16 is secondarily transferred to a recording paper or another medium; and a controller (not shown) that integrates and controls the abovementioned components.

Light L emitted from the exposure part 13 is reflected by a mirror, enlarged from R1 into a wide-ended shape such as R2 in FIG. 2, and guided so that the width R2 of the light L will be in a preset scanning range on the photosensitive drum 11.

The developing unit 14 has a substantially cylindrical rotating body (an example of a rotator) 2 that rotates in a clockwise direction (the direction of the arrow P1) in FIG. 1. The developing unit 14 additionally has color developing parts 5Y, 5M, and 5C, and a black developing part 5K along a direction P1 on an external periphery of the rotating body 2.

Each of the developing parts 5Y, 5M, 5C, and 5K respectively has at least a toner cartridge 4Y, 4M, 4C, and 4K, an upper developing roller 1Y, 1M, 1C, and 1K, and a replenishing roller 3Y, 3M, 3C, and 3K.

The toner cartridges 4Y, 4M, 4C, and 4K respectively contain yellow (Y), magenta (M), cyan (C), and black (K) toner respectively provided from the toner replenishing parts 20Y, 20M, 20C, and 20K. The toner cartridges 4Y, 4M, 4C, and 4K are preferably provided in the interior of the rotating body 2.

The developing rollers 1Y, 1M, 1C, and 1K form a toner image for each color on the surface of the photosensitive drum 11 by causing the toner contained in a developing agent to adhere to the electrostatic latent image formed on the photosensitive drum 11. The toner developing rollers 1Y, 1M, 1C, and 1K are provided across at least the maximum width in the main scanning direction of the electrostatic latent image formed on the photosensitive drum 11.

In other words, the developing rollers 1Y, 1M, 1C, and 1K are provided on an external periphery of the rotating body 2 in the stated order along a circumferential direction. The developing unit 14 causes the developing roller among the developing rollers 1Y, 1M, 1C, and 1K that corresponds to the toner of the color being developed to move to a developing position facing the photosensitive drum 11. The movement is achieved by the rotation of the rotating body 2.

The replenishing rollers 3Y, 3M, 3C, and 3K are externally and respectively tangent to the developing rollers 1Y, 1M, 1C, and 1K, and respectively supply the toner contained in the toner cartridges 4Y, 4M, 4C, and 4K to the developing rollers 1Y, 1M, 1C, and 1K. The replenishing rollers 3Y, 3M, 3C, and 3K are preferably provided in the interior of the rotating body 2.

A remaining toner level detection sensor (not shown) to detect the amount of toner remaining may be provided to the interior of each of the toner cartridges 4Y, 4M, 4C, and 4K.

A toner delivery spiral (not shown) to deliver the toner to the replenishing rollers 3Y, 3M, 3C, and 3K may further be provided to the interior of each of the toner cartridges 4Y, 4M, 4C, and 4K. The toner delivery spiral is a spiral-shaped member that rotates to deliver the toner. When a developing process is performed by the developing roller 1 at a developing position, the toner delivery spiral is rotated by the controller, and the toner is delivered.

As seen in FIG. 4, toner replenishing openings 6Y, 6M, 6C, and 6K, which are openings through which the toner is replenished from the toner replenishing parts 20Y, 20M, 20C, and 20K, are additionally formed on the toner cartridges 4Y, 4M, 4C, and 4K, respectively.

The toner replenishing opening 6Y, which is the opening through which yellow toner is replenished, includes a hole 22 that is provided to an external peripheral surface of the rotating body 2 of the yellow toner cartridge 4Y, as shown in FIG. 4. The hole 22 is closed by an elastic member provided with a substantially cross-shaped incision 24. When a rod-shaped member is pushed into the hole 22 from the exterior, the elastic member is pushed to the inside, the incision 24 opens, and the rod-shaped member penetrates the hole 22. The incision 24 is cut to such a degree that the toner contained in the toner cartridge 4Y will not leak out, and the toner is sealed therein.

The magenta and cyan toner replenishing openings 6M and 6C have the same or similar structure as the toner replenishing opening 6Y, for which reason descriptions thereof have been omitted.

A toner replenishing openings 6Y, 6M, 6C, and 6K having a substantially cross-shaped incision 24 have been described hereinabove. However, another shape may also be used.

The toner replenishing openings 6Y, 6M, 6C, and 6K have a simple structure in order to prevent the apparatus from being made larger; however, this is not a limiting requirement.

The toner replenishing opening 6K, which is the opening through which the black toner is replenished, shall next be described.

The toner replenishing opening 6K is provided at an end portion of the rotating body 2 in the direction of the axis of rotation, as shown in FIG. 4. A lid (not shown) that opens when the black developing roller 1K is in the developing position (the position of FIG. 3A) and closes when the black developing roller 1K is in a position other than the developing position (the position shown in FIG. 3B) is provided to the toner replenishing opening 6K.

Referring to FIG. 1, the toner containers are a yellow toner container 19Y, a magenta toner container 19M, a cyan toner container 19C, and a black toner container 19K.

The toner containers 19Y, 19M, 19C, and 19K are disposed above the photosensitive drum 11 along the direction of the axis of rotation of the rotating body 2 of the developing unit 14. The toner containers 19M, 19C are disposed behind the toner container 19Y in FIG. 1. The toner container 19K is disposed in front of the toner container 19Y in FIG. 1. Only the yellow toner container 19Y is shown in FIG. 1 in order to simplify the description.

Referring now to FIGS. 1 and 2, the toner replenishing parts 20Y, 20M, 20C, and 20K are tubes provided to supply respectively the toner from the toner containers 19Y, 19M, 19C, and 19K to the toner cartridges 4Y, 4M, 4C, and 4K of the developing unit 14. The toner replenishing parts 20Y, 20M, 20C, and 20K correspond to each color. A spiral (not shown) is provided inside the tube of each toner replenishing part 20Y, 20M, 20C, and 20K, and a passage for the toner is formed. As with the toner containers 19Y, 19M, 19C, and 19K, only the toner replenishing part 20Y is shown in FIG. 1 in order to simplify the description.

The toner replenishing part 20Y provided to replenish yellow toner is connected to the toner container 19Y. The end portion on the side that is not connected to the toner container 19Y narrows at the tip to match the size of the toner replenishing opening 6Y so that the toner will readily be supplied from the toner replenishing opening 6Y (see FIG. 4) in the toner cartridge 4Y.

Referring again to FIG. 1, the toner replenishing part 20Y can move in the directions of arrows P4 and P5 shown in FIG. 1. In other words, when the toner is not being replenished, the toner replenishing part 20Y is in a retracted position where light emitted from the exposing part 13 is not obstructed. Further, when the toner is to be replenished, the part moves to a replenishing position (the position shown in FIGS. 1 and 2), which is at a distance from the retracted position and in which light emitted from the exposing part 13 is obstructed, and replenishes the toner.

The magenta and cyan toner replenishing parts 20M and 20C have the same or similar configuration as the toner replenishing part 20Y, for which reason a description thereof has been omitted. However, the toner replenishing parts 20Y, 20M, and 20C are included in the color toner replenishing part.

The black toner replenishing part 20K to replenish black toner shall next be described.

As shown in FIG. 4, the toner replenishing part 20K is preferably a tube that connects the toner container 19K (not shown) and the toner replenishing opening 6K. An end portion T on the side not connected to the toner container 19K is connected and fixed to an end portion of the rotating body 2 as viewed in the direction of the axis of rotation. The lid provided to the toner replenishing opening 6K opens when the black developing roller 1K is in the developing position shown in FIG. 3A. The spiral provided to the interior of the toner replenishing part 20K rotates to deliver the toner in the toner container 19K from the toner replenishing part 20 to the toner cartridge 4K through the toner replenishing opening 6K.

Referring again to FIG. 4, the toner replenishing part 20K is accordingly disposed on an end portion of the rotating body 2 as viewed in the direction of the axis of rotation so that light emitted from the exposing part 13 will not be obstructed.

An imaging process of the imager G shall be briefly described hereinbelow.

Referring to FIG. 1, first, the surface of the photosensitive drum 11 is uniformly charged by the charger 12, and, e.g., a yellow electrostatic latent image is formed by light emitted from the exposing part 13. The developing unit 14 causes the developing roller 1Y for yellow, which is the color to be developed, to rotate to the developing position. As a result of rotating, the developing roller 1Y will carry the yellow toner supplied by the replenishing roller 3Y, and a thin layer of toner formed on the surface of the developing roller 1Y will be brought into contact with the surface of the photosensitive drum 11. The charged toner will accordingly be caused to adhere to the electrostatic latent image on the surface of the photosensitive drum 11, and a toner image will be formed.

The photosensitive drum 11 rotates in a counterclockwise direction (the direction of the arrow P2) in FIG. 1. The yellow toner image is thereby transferred to the intermediate transfer belt 16 by the primary transfer roller 15. The secondary transfer roller 18, which makes contact with the intermediate transfer belt 16, is kept separate from the intermediate transfer belt 16 until the toner images of all the colors are superposed on the intermediate transfer belt 16 and are transferred.

A cleaning part 17 is disposed on a downstream side of the photosensitive drum 11 as viewed in the direction of rotation. Toner and other materials remaining on the surface of the photosensitive drum 11 are removed. A neutralizing lamp (not shown) is provided further along the downstream side of the photosensitive 11 than the cleaning part 17 as viewed in the direction of rotation. Electric potential remaining in the photosensitive drum 11 is removed.

When the formation of the yellow toner image is complete, a series of image-forming processes involving charging, exposure, image development, primary transfer, cleaning, and neutralization is performed in the stated order for each of the black, cyan, and magenta colors. The toner image formed by superposing the colors on the intermediate transfer belt 16 is delivered in direction P3 in FIG. 1 by the intermediate transfer belt 16 and is transferred (secondary transfer) to recording paper or another medium by the secondary transfer roller 18 that is in contact with the intermediate transfer belt 16. The toner image that has been transferred to the recording paper or other medium in the secondary transfer is heated by a fixing roller (not shown) and fixed to the recording paper or other medium.

An example of a sequence of a toner replenishing process executed by the controller shall next be described using the flowchart of FIG. 5.

The toner replenishing process described below, which includes verifying the amount of toner remaining, is performed after the developing process has been completed (i.e., when the imaging process is not being performed).

The process is performed to reduce effects on the imaging process caused by the replenishing of toner and to eliminate user irritation.

In the drawing, S10, S20, . . . indicate the order of the process (steps), and the process starts from step S10.

First, in step S10, the controller determines whether the amount of toner remaining in one of the toner cartridge 4Y, 4M, 4C, and 4K provided to its respective developing part 5Y, 5M, 5C, and 5K is low. If the controller determines that the amount of toner remaining is low according to the results of the sensor to detect the amount of toner remaining (the Yes side of step S10), then the process proceeds to step S20. If the controller determines that the amount of toner remaining is not low according to the results of the sensor to detect the amount of toner remaining (the No side of step S10), the toner in the toner cartridge 4Y, 4M, 4C, and 4K does not need to be replenished, and the process therefore ends.

In step S20, the controller determines whether the developing roller 1Y, 1M, 1C, or 1K of the color of the toner contained in the toner cartridges 4Y, 4M, 4C, or 4K that has been determined to have a low level of remaining toner is in a position other than the developing position. If multiple toner cartridges have been determined to have a low level of remaining toner, positions of the developing rollers 1Y, 1M, 1C, and 1K are determined for the color toners contained in the toner cartridges 4Y, 4M, 4C, AND 4K that have been determined to have low level of remaining toners. The determination is made in sequence that starts with an arbitrary roller selected from the developing rollers 1Y, 1M, 1C, and 1K. If the controller determines that the developing roller 1Y, 1M, 1C, or 1K for the color toner contained in its respective toner cartridge 4Y, 4M, 4C, and 4K that has been determined to have a low level of remaining toner is in a position other than the developing position (the Yes side of step S20), then the process proceeds to step S30. If the controller determines that the developing roller 1Y, 1M, 1C, or 1K for the color toner contained in the toner cartridge 4Y, 4M, 4C, or 4K that has been determined to have a low level of remaining toner is in the developing position (the No side of step S20), then the process proceeds to step S40.

In step S30, the developing roller 1Y, 1M, 1C, or 1K for the toner contained in the toner cartridge 4Y, 4M, 4C, or 4K that has been determined to have a low level of remaining toner is rotated to the developing position by the rotating body 2, and the process proceeds to step S40.

In step S40, the controller determines the toner contained in the toner cartridge 4Y, 4M, 4C, and 4K that is disposed in the developing position and that has been determined to have a low level of remaining toner to be either a color toner (yellow, magenta, cyan, or other toner) or a black toner. If the toner contained in the toner cartridge 4Y, 4M, or 4C that is disposed in the developing position and that has been determined to have a low level of remaining toner is determined to be a color toner (the Yes side of step S40), then the process proceeds to step S50. If the toner contained in the toner cartridge 4K that is disposed in the developing position and that has been determined to have a low level of remaining toner is determined to be a black toner (the No side of step S40), then the process proceeds to step S61.

In step S50, the toner replenishing part 20 for the color the toner contained in the toner cartridge 4Y, 4M, or 4C that has been determined to have a low level of remaining toner is moved from the retracted position to the replenishing position by the controller. The movement is performed by a motor, a solenoid, or another actuator not shown in the drawing. Once the color toner replenishing part 20Y, 20M, or 20C has been moved to the replenishing position, the end portion of the part on the side not connected to the toner container 19Y, 19M, or 19C is inserted into the hole 22Y, 22M, or 22C formed on the toner replenishing opening 6Y, 6M, or 6C of the color of the toner contained in the toner cartridge 4Y, 4M, or 4C that is disposed in the developing position and that has been determined to have a low level of remaining toner. The elastic member provided to the toner replenishing opening 6Y, 6M, or 6C is pushed inside by this insertion, and the incision 24 opens. The color toner replenishing part 20Y, 20M, or 20C thereby connects the toner container 19Y, 19M, or 19C and toner cartridge 4Y, 4M, or 4C, and the process proceeds to step S60.

The color toner replenishing part 20Y, 20M, or 20C is moved to the replenishing position, and, once the color toner replenishing part 20Y, 20M, or 20C has been moved to the replenishing position, the end portion of the part on the side not connected to the toner container 19Y, 19M, or 19C is connected to the toner replenishing opening 6Y, 6M, or 6C, and toner is replenished as in step S60 described hereunder. This process corresponds to the process of the present invention wherein "the color toner replenishing part comes into close proximity to the color toner developing part disposed in the developing position, and replenishes the toner."

In this way, replenishing the toner in a state in which the container 19Y, 19M, or 19C and the toner cartridge 4Y, 4M, or 4C are connected can eliminate the factors that impede the imaging process, such as scattering of toner in the surrounding area.

In step S60, the spiral (not shown) provided inside the tube of the color toner replenishing part 20Y, 20M, or 20C is moved by the controller, and the toner contained in the toner container 19Y, 19M, or 19C is delivered to the toner cartridge 4Y, 4M, or 4C. In the toner cartridge 4Y, 4M, or 4C, if the remaining toner level detecting sensor detects that the toner has reached a predetermined level, the spiral is halted by the controller, the delivery of the toner is stopped, and the process returns to step S 10.

In step S61, the black developing roller 1K is in the developing position, as shown in FIG. 3A. Therefore, the lid provided to the toner replenishing opening 6K opens, and the spiral (not shown) provided to the interior of the toner replenishing part 20K rotates, thereby delivering the toner contained in the toner container 19K to the black toner cartridge 4K. If the remaining toner level detecting sensor detects that the toner has reached a preset amount in the toner cartridge 4K, the spiral is halted by the controller, the delivery of toner is stopped, and the process returns to step S10.

In this way, the toner replenishing part 20K for black toner, which is used often in monochromatic printing, replenishes the toner of the black toner cartridge 4K in a position where light emitted from the exposing part 13 is not obstructed. In addition, the toner replenishing parts 20Y, 20M, and 20C of the non-black color toners, which are not used often in monochromatic printing, move from the retracted position, where light emitted from the exposing part 13 is not obstructed, to a replenishing position, which is at a distance from the retracted position and in which light emitted from the exposing part 13 is obstructed, whereupon the color toner cartridges are replenished with color toner. In this way, only the black toner replenishing part 20K is disposed in a position outside the exposure area. Therefore, the apparatus can be very effectively kept from increasing in size when compared to conventional imaging apparatuses, in which toner replenishing parts of four colors are disposed in positions outside the exposure area. It shall be apparent that user irritation can be lessened because the imaging process will not be interrupted by the replenishing of the toner when a black monochromatic imaging process is being continuously performed.

A description has been provided using the rotary four-color imaging apparatus X1 as an example. However, provided that the apparatus is a rotary multi-color imaging apparatus in which color toners and a black toner are used, no distinction will be made in regard to the use of colors other than those given as examples, or to the number of colors.

As described in the above embodiment, the black toner replenishing part is provided to a position where light emitted from the exposure unit is not obstructed. The black developing means is replenished with toner in this position, thereby allowing an imaging apparatus to be provided wherein the incidence of exposure being impeded when the toner is replenished is minimized while the apparatus is prevented from being made larger.

In the imaging apparatus, the color toner replenishing part preferably comes into close proximity to the color toner developing part disposed in the developing position, and replenish the toner.

The reason is that the toner will scatter into the surrounding area and the imaging process will be hindered if the replenishing part is not in proximity when the toner is to be replenished.

The color toner replenishing parts may replenish toner before or after the developing process in the toner developing part of the color that is replenished; i.e., when the imaging process in the imagining apparatus is not being performed.

The effects on the imaging process caused by the replenishing of toner will be alleviated thereby, and user irritation will be eliminated.

"Means plus function" clauses as utilized in the specification and claims should include any structure or hardware and/or algorithm or software that can be utilized to carry out the function of the "means plus function" clause.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An imaging apparatus comprising:

an image carrier being configured to carry an electrostatic latent image;

an exposure unit being configured to irradiate said image carrier with light and to form the electrostatic latent image;

a color developing part being configured to develop said electrostatic latent image on said image carrier by using color toners;

a black developing part being configured to develop said electrostatic latent image on said image carrier by using a black toner;

a rotator being configured to have said color developing part and black developing part disposed on an external periphery thereof, and being configured to move said color developing part or black developing part by rotation to a developing position to face said image carrier in accordance with the color being developed;

a color toner replenishing part being configured to move from a retracted position arranged to allow light emitted from said exposure unit to irradiate said image carrier obstructed, to a replenishing position arranged to obstruct light emitted from said exposure unit, and being configured to replenish said color toners of said color developing part in said replenishing position; and a black toner replenishing part at an axial end of said rotator and being arranged to have retracted and replenishing positions allowing light emitted from said exposure unit to irradiate said image carrier obstructed, and being configured to replenish black toner to said black developing part in a replenishing position.

2. The imaging apparatus according to claim 1, wherein said color toner replenishing part comes into close proximity to said color developing part disposed in said developing position, and replenishes said color toners.

3. The imaging apparatus according to claim 1, wherein said color toner replenishing part replenishes at least one of said color toners before or after a developing process in the color developing part that corresponds to the toner of the color to be replenished.

4. The imaging apparatus according to claim 1, wherein said color toner replenishing part replenishes at least one of said color toners when an imaging process in said imaging apparatus is not being performed.

5. The imaging apparatus according to claim 2, wherein said color toner replenishing part replenishes at least one of said color toners when an imaging process in said imaging apparatus is not being performed.

6. The imaging apparatus according to claim 3, wherein said color toner replenishing part replenishes at least one of said color toners when an imaging process in said imaging apparatus is not being performed.

* * * * *